US005722335A

United States Patent [19]

Kamewada et al.

[11] Patent Number: 5,722,335

[45] Date of Patent: Mar. 3, 1998

[54] THREAD CUTTING DEVICE OF A SEWING MACHINE

[75] Inventors: Makoto Kamewada; Shinji Kojima, both of Utsunomiya, Japan

[73] Assignee: The Singer Company N.V., Curaco, Netherlands Antilles

[21] Appl. No.: 704,970

[22] Filed: Aug. 29, 1996

[30] Foreign Application Priority Data

Sep. 14, 1995 [JP] Japan ..... 7-262488

[51] Int. Cl.[6] ..... D05B 65/00

[52] U.S. Cl. ..... 112/285; 112/259

[58] Field of Search ..... 112/285, 293, 112/80.7, 86.71, 295, 298, 258, 259; 225/42, 6, 23; 26/7, 11, 10.4; 83/902, 905, 910, 909

[56] References Cited

U.S. PATENT DOCUMENTS

| | | | |
|---|---|---|---|
| 2,226,689 | 12/1940 | Barber | 112/259 X |
| 3,136,276 | 6/1964 | Miiyake | 112/293 |
| 4,606,289 | 8/1986 | Hara et al. | 112/295 |
| 5,054,674 | 10/1991 | Fortman | 225/6 |

FOREIGN PATENT DOCUMENTS

| | | | |
|---|---|---|---|
| 84658 | 8/1983 | European Pat. Off. | 112/285 |
| 3612837 | 10/1987 | Germany | 112/285 |
| 3275393 | 11/1988 | Japan | 112/285 |

*Primary Examiner*—Ismael Izaguirre
*Attorney, Agent, or Firm*—McCormick, Paulding & Huber

[57] ABSTRACT

A thread cutting device of a sewing machine comprising a groove defined in a sewing machine, the groove extending back and forth and having an opening at a back end thereof, a plurality of thread cutting blades having inclined grooves along which each piece of thread cutting blades can be broken off every given interval, wherein a tip end of each thread cutting blade is disposed to across an intermediate portion of the groove, and the each thread cutting blade is fixed to the sewing machine by way of a detachable fixing means.

4 Claims, 6 Drawing Sheets

[ Fig. 1 ]
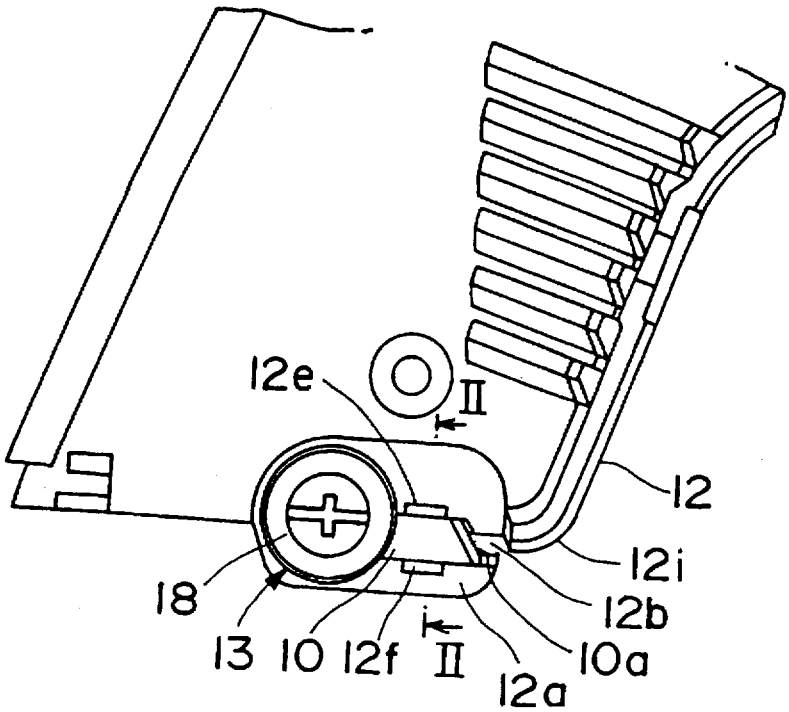
[ Fig. 2 ]
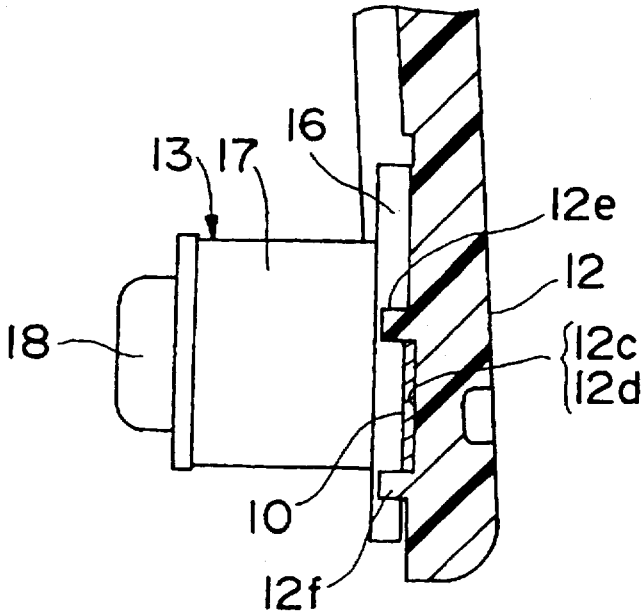

[ Fig. 3 ]
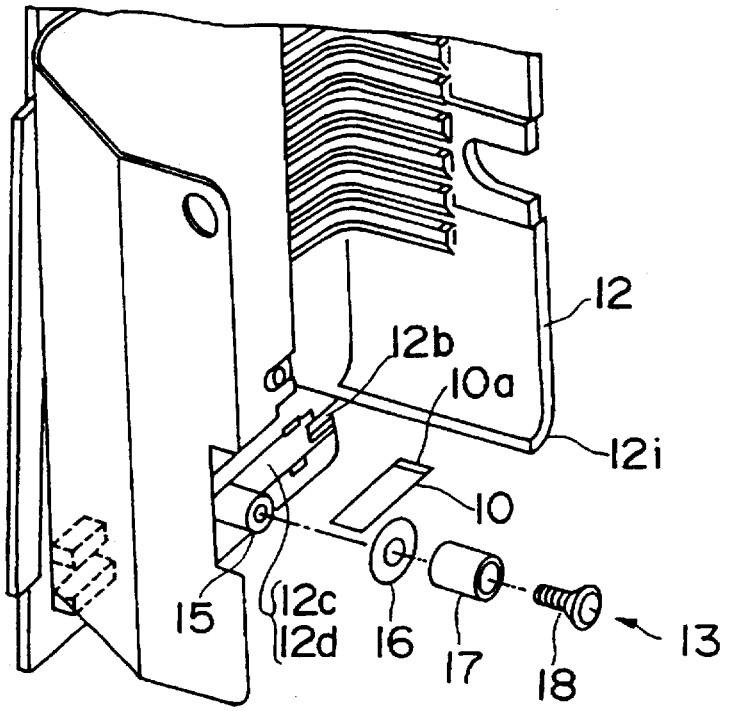
[ Fig.4 ]
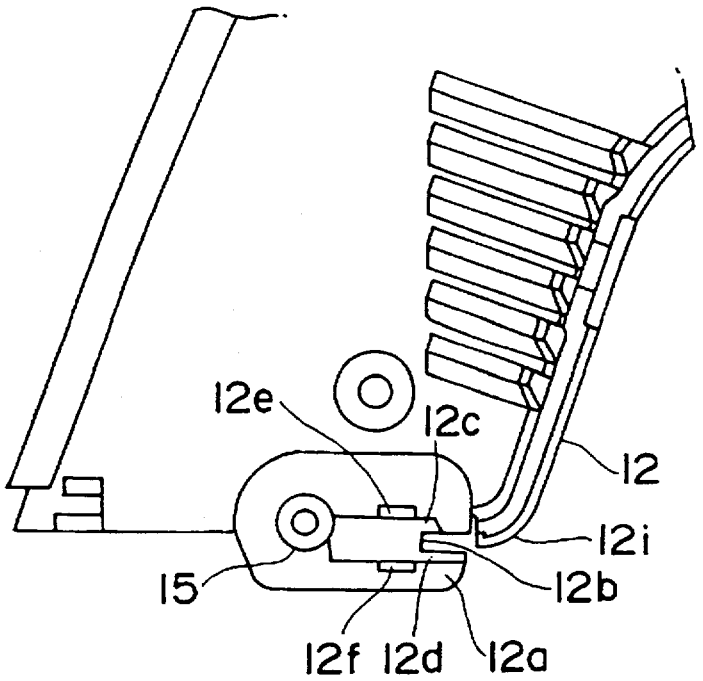

[ Fig. 5 ]
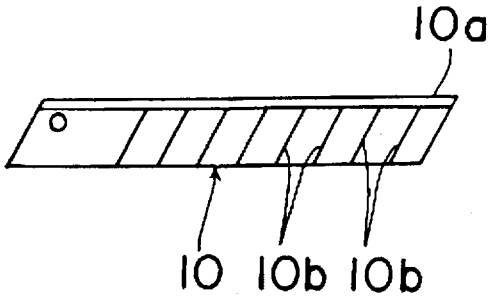
[ Fig. 6 ]
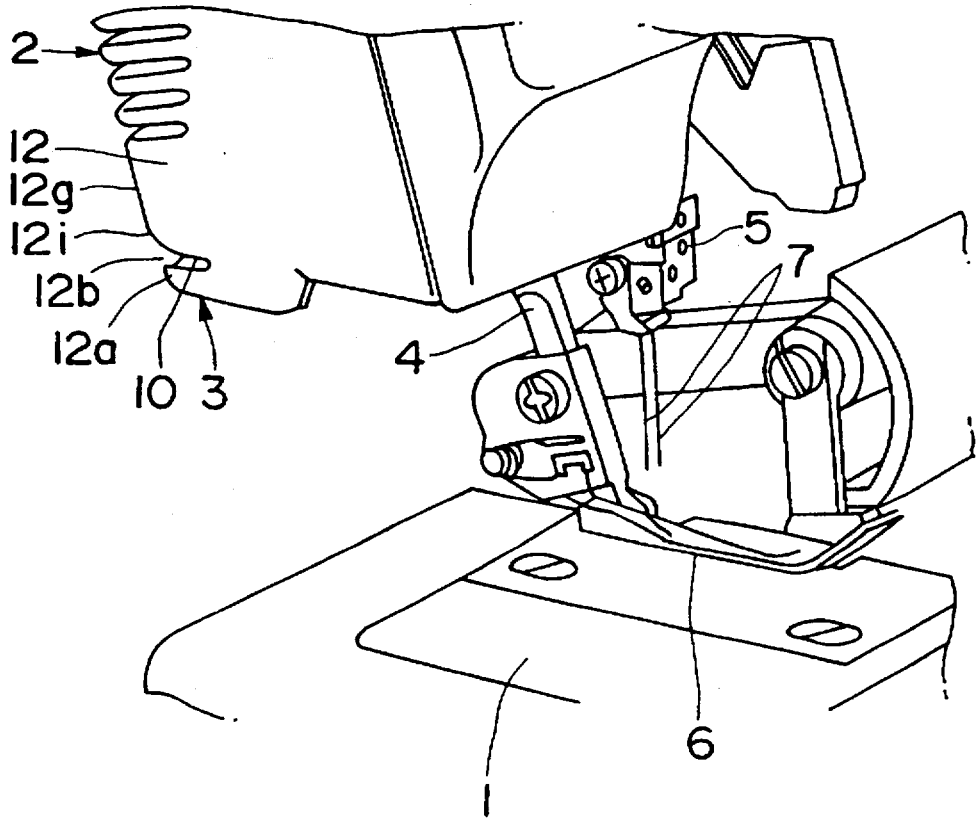

[ Fig. 7 ]
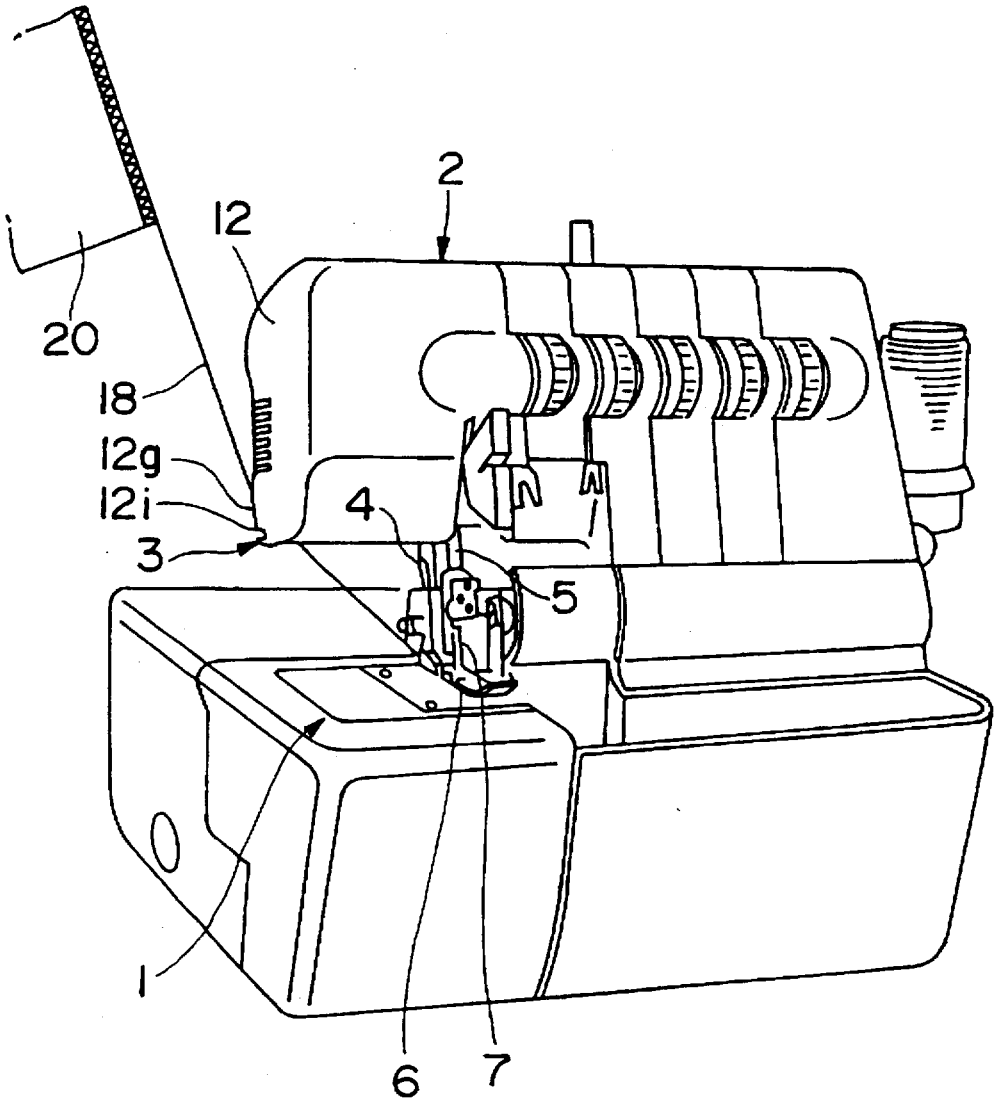

[ Fig. 8 ]
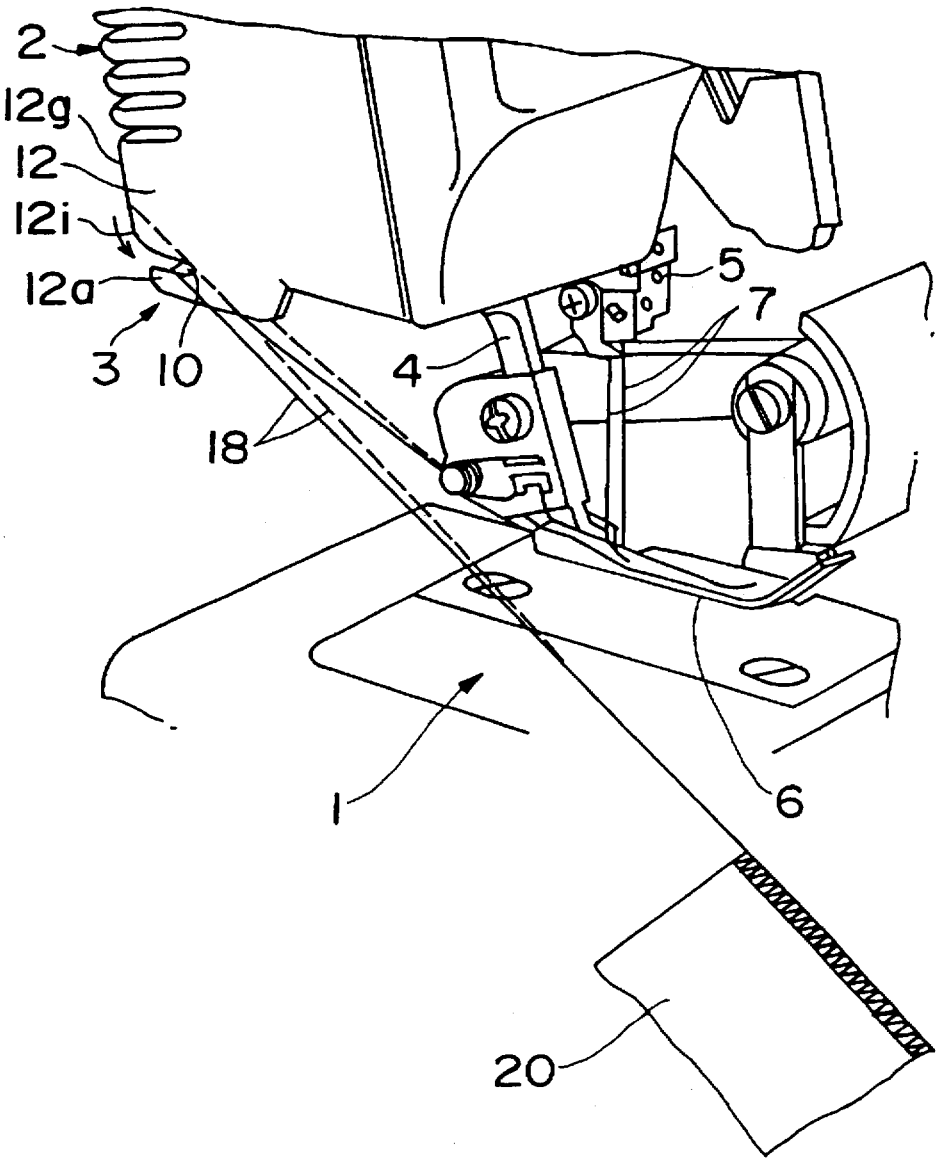

[ Fig. 9 ]
PRIOR ART
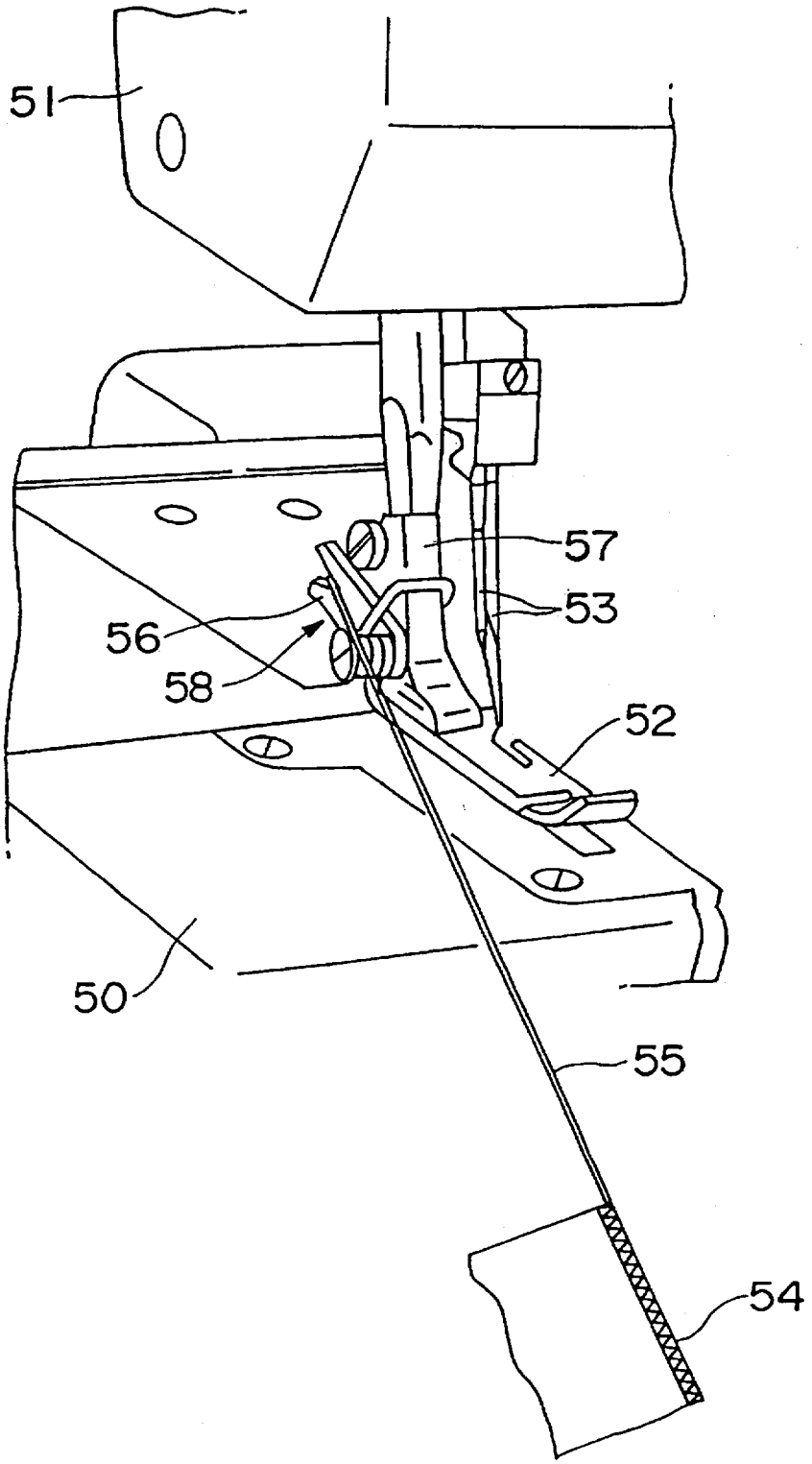

THREAD CUTTING DEVICE OF A SEWING MACHINE

BACKGROUND OF THE INVENTION

1. Field of the Invention

The present invention relates to a thread cutting device of a sewing machine.

2. Prior Art

As a prior art thread cutting device of a sewing machine, there in known, for example, an overlock sewing machine as shown in FIG. 9. In FIG. 9, denoted by 50 is a bed of a sewing machine, 51 is an arm of the sewing machine, 52 is a presser foot, and 53 are needles. In the sewing machine, threads 55 such as looper threads and needle threads are cut off by a thread cutting device 58 when a material 54 to be sewn (workpiece) has been completely sewn. A thread cutting operation of the threads 55 is carried out as follows.

A thread cutting blade 56 of the thread cutting device 58 is fixed to a presser foot shank 57 so that a V-shaped blade is gradually increased in its width in the backward direction of the sewing machine. When the threads 55 are cut off, the workpiece 54 is once stretched in the backward direction of the sewing machine, the threads 55 are fed, successively the workpiece 54 is moved in the forward direction of the sewing machine. When the workpiece 54 is moved in the forward direction of the sewing machine, the threads 55 are received by the V-shaped thread cutting blade 56. From this state, the workpiece 54 is further stretched in the forward direction of the sewing machine, then the threads 55 are brought into contact with the thread cutting device 56 so as to cut off the workpiece 54.

However, the prior art thread cutting device of the sewing machine has the following technical problems.

Since the thread cutting blade 56 has a special V-shaped blade, the thread cutting blade 56 is complex in its structure and is difficult in manufacturing thereof, and the recovery of sharpness of the thread cutting blade 56 and the replacement with another blade cannot be performed easily when the sharpness or cutting quality thereof is deteriorated.

Further, there are following other problems.

When the threads 55 are cut off, the threads 55 must be received by the V-shaped thread cutting blade 56, so that the intermediate portion of the threads 55 must be put into the V-shaped thread cutting blade 56 while the thread cutting blade 56 is watched carefuly. Accordingly, the thread cutting operation was difficult. Further, since the thread cutting blade 56 is fixed to the presser foot shank 57, firm fixing was difficult and the thread cutting device 56 was arranged at a portion close to the bed 50 of the sewing machine. As a result, the threads 55 and the workpiece 54 are liable to be caught by the thread cutting blade 56, causing the interruption of the sewing operation.

SUMMARY OF THE INVENTION

The present invention has been made to solve the aforementioned problems of the prior art thread cutting device of a sewing machine, the structure of which is as follows.

The thread cutting device of a sewing machine according to the first aspect of the invention comprises a groove **12*b* defined in a sewing machine, the groove 12*b* extending back and forth and having an opening at a back end thereof, a plurality of thread cutting blade 10 for a use as a cutter (snap off blade cutter) having inclined grooves 10*b* along which each piece of thread cutting blade 10 can be broken off every given interval, wherein a tip end 10*a* of each thread cutting blade 10 is disposed to across an intermediate portion of the groove 12*b*, and the each thread cutting blade 10 is fixed to the sewing machine by way of a detachable fixing means 13**.

The thread cutting device of a sewing machine according to the second aspect of the invention is characterized in that the groove **12*b* in the first aspect of the invention is defined in a left rear lower portion of an arm 2 of the sewing machine, wherein the groove 12*b* extends back and forth and has an opening at a back end thereof connected to a left rear side surface of the arm 2** of the sewing machine.

The thread cutting device according to the third aspect of the invention is characterized in further comprising in addition to the second aspect of the invention, a protrusion formed at a lower end portion of the arm 2 of the sewing machine, wherein the groove **12*b* is defined between the arm 2 of the serving machine and the protrusion 12*a*, and recessed fixing seats 12*c* and 12*d* respectively formed on upper and lower side portions of the groove 12*b* deigned in the inner surface between the arm 2 of the sewing machine and the protrusion 12*a*, and wherein the thread cutting blade 10 is received by and fixed to the fixing seats 12*c* and 12*d***.

According to the first aspect of the embodiment, the threads are cut off by the thread cutting device when the workpiece is completely sewn. When the threads are cut off, the workpiece is once stretched toward the backward of the sewing machine, then the threads are fed, successively the workpiece is moved in the forward direction of the sewing machine. When the workpiece is moved in the forward direction of the sewing machine, the threads are received into the groove **12*b*. From this state, the workpiece is further stretched in the forward direction of the sewing machine, then the threads are brought into contact with the edge 10*a* of the thread cutting blade 10**, so as to cut off the workpiece.

When the blade **10*a* is worn and deteriorated in sharpness, i.e. cutting quality, a fixing means 13 is released to take out the thread cutting blade 10 and to replace with a new thread cutting blade 10. The new thread cutting blade 10 is formed by breaking off a cutting blade used as a cutter available in market along grooves 10*b* defined therein, thereby forming a piece of thread cutting blade 10 having the edge 10*a* and having the shape of parallelogram. The new thread cutting blade 10 is fixed again by fie fixing means 13**.

According to the second aspect of the invention, when the workpiece is moved forward and the threads are received into the groove **12*b*, the threads are lowered while it is guided along the left back surface of the arm 2 of the sewing machine. The threads are slid spontaneously into the groove 12*b* when they pass through the lower edge of the left back surface of the arm 2** of the sewing machine.

According to the third aspect of the invention, the thread cutting blade 10 is received by the fixing seats **12*c* and 12*d***, and fixed firmly thereto.

DESCRIPTION OF THE DRAWINGS

FIG. 1 is a side view showing a thread cutting device of a sewing machine according to a preferred embodiment of the present invention;

FIG. 2 is a cross sectional view taken along the line II—II in FIG. 1;

FIG. 3 is an exploded perspective view of the thread cutting device of a sewing machine according to the present invention;

FIG. 4 is a side view of a main part of a right cover according to the present invention;

FIG. 5 is a view of a cutter blade which is available in a market according to the present invention;

FIG. 6 is a perspective view showing a main part of a sewing machine according to the present invention;

FIG. 7 is a view for explaining a cutting operation of the thread cutting device of a sewing machine according to the present invention;

FIG. 8 is a view for explaining a cutting operation of the thread cutting device of a sewing machine according to the present invention; and FIG. 9 is a perspective view showing a prior art thread cutting device of a sewing machine.

DESCRIPTION OF THE PREFERRED EMBODIMENT

The thread cutting device of a sewing machine according to a preferred embodiment of the present invention will be described hereinafter with reference to drawings.

FIGS. 1 through 8 show the first embodiment applied to a thread cutting device of an overlock sewing machine. In FIGS. 6 through 8, denoted by 1 is a bed of a sewing machine, and an arm 2 of the sewing machine is positioned above the bed of the sewing machine. A presser bar 4 and a needle bar 5 are provided to hang from the arm 2 of the sewing machine. A presser foot 6 is detachably attached to the lower end of the presser bar 4. Needles 7 are detachably attached to the lower end of the needle bar 5.

A thread cutting device 3 is provided on the back of the arm 2 of the sewing machine. The thread cutting device 3 is provided on a light cover 12 constituting the left end portion of the arm 2 of the sewing machine as viewed from the front of the sewing machine. That is, a protrusion 12*a* is provided to protrude from the left back lower portion of the light cover 12 so as to extend backward while it protrudes downward beyond the lower edge of the back side of the light cover 12. The protrusion 12*a* is made of plastic and integrated with the light cover 12. Thus, slit-like groove 12*b* which is open at the back end is formed between the protrusion 12*a* and the lower surface of the light cover 12. The back lower edge of the light cover 12 forms a curved surface 12*i*, and the groove 12*b* is open at the lower end of the curved surface 12*i*.

A thread cutting blade 10 is disposed at the intermediate portion of the groove 12*b* with respect to the back and forth direction of the light cover 12 and arranged in the inner surface of the light cover 12. A cutting blade which is available in the market is used as a thread cutting blade 10. The cutting blade available in the market has an edge 10*a* disposed at one side edge thereof in the longitudinal direction thereof and inclined grooves 10*b* which can be broken off every given interval from a tip end thereof. When the cutting blade is broken off along adjoining inclined grooves 10*b*, a piece of the cutting blade having the edge 10*a* and having the shape of parallelogram can be obtained and this piece forms the thread cutting blade 10. The thread cutting blade 10 is fixed to the light cover 12 by the detachable fixing means 13 so that the edge 10*a* extends across the intermediate portion of the groove 12*b*. In a state where the thread cutting device 10 is fixed to the light cover 12, the edge 10*a* is inclined downward in the backward direction.

Opposed recessed fixing seats 12*c* and 12*d* are formed on the upper and lower sides of the groove 12*b* defined in the inner surface of the light cover 12, namely, on the lower end portion of the light cover 12 and the upper end portion of the protrusion 12*a*. The thread cutting blade 10 is received into and fixed to the fixing seats 12*c* and 12*d* so as to prevent the thread cutting blade 10 from jolting. The fixing seats 12*c* and 12*d* join with each other at a front end of the groove 12*b* so as to extend forward. 5 Accordingly, the fixing seats 12*c* and 12*d* extend to a portion where the protrusion 12*a* is connected to the light cover 12. Each depth of the fixing seats 12*c* and 12*d* is set to be smaller than the thickness of the thread cutting blade 10.

A boss 15 having a female screw is formed at the front end portions of the fixing seats 12*c* and 12*d*. The boss 15 substantially contacts the front end portion of the thread cutting blade 10 which is received into the fixing seats 12*c* and 12*d*. Whereupon, as shown in FIGS. 2 and 3, the front end portion of the thread cutting blade 10 is clamped by and fixed to the light cover 12 by way of an annular member 16 by permitting the thread cutting blade 10 to be received into the fixing seats 12*c* and 12*d*, engaging the annular member 16 which is a large diameter washer and a cylindrical spacer 17 sequentially in the boss 15, screwing a set screw 18 into the female screw of the boss 15, and pressing the annular member 16 to the blade 10 by way of the spacer 17. Protrusions 12*e* and 12*f* respectively formed on the upper and lower sides of the fixing seats 12*c* and 12*d* firmly support the thread cutting blade 10 at the upper and lower sides thereof and they are formed to avoid interference with the spacer 17.

The operation of the thread cutting device will be now described.

A workpiece 20 is sewn by needle threads inserted into the needles 7 and threads 18 such as looper threads. Upon completion of the sewing of the workpiece 20, the workpiece 20 is released from the pressing by the presser foot 6 so that the workpiece 20 is moved in a backward direction of the sewing machine. As a result, the threads 18 connected to the workpiece 20 at one end thereof are fed. Successively, the workpiece 20 is moved in the forward direction (this side in FIG. 7) of the sewing machine after it is permitted to pass through the left side of the arm 2 of the sewing machine while it is lifted high in the backward direction of the arm 2 of the sewing machine, and is permitted to retain the intermediate portion of the threads 18 by, a smooth left back surface cornered portion 12*g* of the light cover 12 so as to be brought into contact with the same cornered portion 12*g*. Since the smooth left back surface cornered portion 12*g* of the light cover 12 extends relatively long in a vertical direction, the operation to retain the intermediate portion of the threads 18 by the smooth left back surface cornered portion 12*g* can be easily performed.

Successively, when a slight tension is applied to the threads 18 and the workpiece 20 is gradually lowered while maintaining a state where the intermediate portion of the threads 18 is brought into contact with the smooth left back surface cornered portion 12*g* of the light cover 12, the threads 18 are gradually lowered while they are guided along the curved surface 12*i* of the light cover 12 and the smooth left back surface cornered portion 12*g*. When the threads 18 are retained by the curved surface 12*i* alone, the threads 18 are quickly lowered to the lower end along the curved surface 12*i*, and it is spontaneously put into the groove 12*b* which is open at the back thereof. In such a manner the threads 18 are lowered while they are guided by the curved surface 12*i* of the light cover 12 and the smooth left back surface cornered portion 12*g*, and they are spontaneously put into the groove 12*b* from the state as shown as broken lines in FIG. 8. As a result, the threads 18 can be surely received into the groove 12*b* if the width of the tip end of the opening of the groove 12*b* is reduced. Further, if the workpiece 20 is pulled forward, the threads 18 advance in the groove 12*b* and contacts the edge 10*a* of the thread cutting blade 10 which extends across the intermediate portion of the groove 12*b*, and they are finally cut off. Since the edge 10*a* is inclined downward while directing backward, it can cut off the threads 18 which are moved while they are lowered from the upper portion thereof with excellent performance.

When the workpiece 20 is repeatedly sewn, the edge 10*a* is deteriorated in the sharpness thereof. At this time, the fixing means 13 is released, namely, it is unscrewed so as to take out the thread cutting blade 10 and it is replaced by a new thread cutting blade 10. That is, the set screw 18 is loosened so as to release the pressing of the thread cutting blade 10 by the annular member 16 so as to take out the thread cutting blade 10 from the fixing seats 12*c* and 12*d*. At this time, it is possible to remove the spacer 17 and the annular member 16 by completely taking out the set screw 18 from the boss 15. The new thread cutting blade 10 is formed of a piece of thread cutting blade 10 having the edge 10*a* and a shape of parallelogram, which is prepared by breaking off the cutting blade available in the market along the inclined grooves 10*b*. The new thread cutting blade 10 is again fixed to the fixing seats 12*c* and 12*d* by the fixing means 13. In such a manner, the sharpness of the thread cutting blade 10 can be recovered.

Although the fixing means 13 for fixing the thread cutting blade 10 to the recessed fixing seats 12*c* and 12*d* of the light cover 12 comprises the annular member 16, the spacer 17 and the set screw 18 respectively for fixing the blade to the boss 15 of the light cover 12 in the preferred embodiment, the fixing means 13 can comprise only the boss 15 having a low height and the set screw, and the thread cutting blade 10 can be detachably fixed to the groove 12*b* by the set screw alone. Further, although the thread cutting blade 10 is provided at the inner surface of the light cover 12 in the preferred embodiment, it is possible to be attached to the outer surface of the light cover 12. Still further, it is also possible to provide the thread cutting device 3 by forming the groove 12*b*, which extends back and forth and is open at the back end, at an arbitrary portion of the sewing machine, and fixing the thread cutting blade 10 to the groove 12*b* while it is disposed across the groove 12*b*.

As is well understood from the above explanation, the present invention has the following effects.

(1) According to the first aspect of the invention, since the cutter blade available in the market is used as the thread cutting blade, the thread cutting blade is simple in structure and is low in cost. Further, when the sharpness of the thread cutting blade is deteriorated, the recovery of the sharpness can be easily performed by replacing such thread cutting blade with a new one.

(2) According to the second aspect of the invention, the threads can be cut off without being seen the thread cutting device of a sawing machine since the threads are spontaneously slid into the groove and contacts the thread cutting blade to be cut off. Further, since the threads are spontaneously slid into the groove, the width of the groove can be made small so that the thread cutting blade is positioned at the intermediate portion of the groove having the narrow width, whereby fingers are not liable to contact the thread cutting blade thereby ensuring the safety. Still further, since the thread cutting device is provided on the arm of the sewing machine and is not disposed in a portion adjacent to the bed of the sewing machine the width of the groove can be reduced, and the threads are or the workpiece is difficult to be caught by the thread cutting device. As a result, the interruption of the sewing operation caused by the catching by the thread cutting device is prevented, thereby improving the sewing operating efficiency.

What is claimed is:

1. A sewing machine having a thread cutting device, comprising:

an arm;

a groove defined by the arm and having an opening end at a back end thereof;

a cutting blade having a plurality of inclined grooves defined at given intervals along which, portions of the cutting blade can be broken off to expose a new cutting edge; and wherein a tip end of said thread cutting blade is disposed across an intermediate portion of said groove, and said thread cutting blade is fixed to said sewing machine by detachable fixing means.

2. A sewing machine having a thread cutting device as defined by claim 1, wherein said groove is located on said arm at a rear lower portion thereof, said groove extending back and forth and having an opening at a back end thereof connected to a side surface of said arm.

3. A sewing machine having a thread cutting device as defined by claim 2, further including a protrusion formed at a lower end portion of said arm of said sewing machine, said groove being defined between said arm of said sewing machine and said protrusion, and wherein said arm further includes recessed fixing seats respectively formed on upper and lower side portions of said groove, said thread cutting blade being received by and fixed to said fixing seats.

4. A sewing machine having a thread cutting device, comprising:

an arm defining a groove and having a lower end portion defining a protrusion, said groove being positioned in a left rear lower portion of the arm between the protrusion and the arm, the groove extending back and forth and defining an opening at a back end thereof connected to a left rear side surface of said arm of said sewing machine, the groove further including recessed fixing seats formed on upper and lower side portions of said groove;

a cutting blade received by and fixed to said fixing seats, and having a plurality of inclined grooves defined at given intervals, such that said cutting blade can be broken off along said inclined grooves thereby providing a new thread cutting edge; and wherein a tip end of said thread cutting blade is disposed across an intermediate portion of said groove, and said thread cutting blade is fixed to said sewing machine by way of a detachable fixing means.

* * * * *